US011852989B2

(12) United States Patent
Ariizumi

(10) Patent No.: US 11,852,989 B2
(45) Date of Patent: Dec. 26, 2023

(54) DEVELOPING DEVICE

(71) Applicant: CANON KABUSHIKI KAISHA, Tokyo (JP)

(72) Inventor: Osamu Ariizumi, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/098,851

(22) Filed: Jan. 19, 2023

(65) Prior Publication Data

US 2023/0251590 A1 Aug. 10, 2023

(30) Foreign Application Priority Data

Jan. 27, 2022 (JP) ..... 2022-011049
Jan. 11, 2023 (JP) ..... 2023-002490

(51) Int. Cl.
*G03G 15/08* (2006.01)
*G03G 21/00* (2006.01)
*G03G 9/107* (2006.01)

(52) U.S. Cl.
CPC ..... *G03G 15/0812* (2013.01); *G03G 9/107* (2013.01); *G03G 15/0808* (2013.01); *G03G 15/0818* (2013.01); *G03G 21/0064* (2013.01)

(58) Field of Classification Search
CPC ..... G03G 15/0808; G03G 15/0818; G03G 15/0812; G03G 15/0893; G03G 15/5045
USPC ..... 399/119, 279
See application file for complete search history.

(56) References Cited

U.S. PATENT DOCUMENTS 9,846,392 B2 * 12/2017 Noguchi ..... G03G 15/0893
10,152,000 B2 12/2018 Ariizumi
10,496,008 B2 * 12/2019 Okada ..... G03G 15/5045
10,642,192 B2 5/2020 Ariizumi et al.

FOREIGN PATENT DOCUMENTS

JP 2008-233223 A 10/2008
JP 2009-198582 A 9/2009
JP 2014-153608 A 8/2014

* cited by examiner

*Primary Examiner* — Hoan H Tran
(74) *Attorney, Agent, or Firm* — VENABLE LLP

(57) ABSTRACT

A developing device includes first and second chambers, a partition wall, first and second feeding screws, a developing roller, a supplying roller, a first magnet including a first magnetic pole, a second magnet including second to fourth magnetic poles, and a guiding portion. With respect to a supplying roller rotational direction, in a position downstream of the third magnetic pole, a magnetic flux density of the fourth magnetic pole in a normal direction is 20% of a maximum value thereof is a first position positioned downstream of a second position where a line connecting a lowermost end of the guiding portion and a supplying roller center crosses an outer peripheral surface of the supplying roller, and upstream of a third position where a line connecting an uppermost end of the first feeding screw and the supplying roller center crosses the outer peripheral surface of the supplying roller.

10 Claims, 9 Drawing Sheets

(a) EMB. 1

| | MAXIMUM OF Br | | SCOOPING START MAGNETIC FORCE POSITION | | | | REGION A | |
|---|---|---|---|---|---|---|---|---|
| | | | 20% OF MAX(UPSTREAM) | | 15% OF MAX(UPSTREAM) | | | |
| | POSITION OF POLE[° ] | Br [mT] | POSITION OF POLE[° ] | Br [mT] | POSITION OF POLE[° ] | Br [mT] | α POSITION ANGLE[° ] | β POSITION ANGLE[° ] |
| N1 | 0 | 91 | | | | | | |
| S3 | 85 | 40 | | | | | | |
| S2 | 230 | 42 | 215 | 9 | 210 | 6 | 195 | 240 |
| N2 | 264 | 58 | | | | | | |
| S1 | 313 | 56 | | | | | | |

(b) COMP.EX.

| | MAXIMUM OF Br | | SCOOPING START MAGNETIC FORCE POSITION | | | |
|---|---|---|---|---|---|---|
| | | | 20% OF MAX(UPSTREAM) | | 15% OF MAX(UPSTREAM) | |
| | POSITION OF POLE[° ] | Br [mT] | POSITION OF POLE[° ] | Br [mT] | POSITION OF POLE[° ] | Br [mT] |
| N1 | 0 | 91 | | | | |
| S3 | 85 | 40 | | | | |
| S2 | 210 | 42 | 183 | 9 | 170 | 6 |
| N2 | 264 | 58 | | | | |
| S1 | 313 | 56 | | | | |

Fig. 6

EMB. 2

| | MAXIMUM OF Br | | SCOOPING START MAGNETIC FORCE POSITION | | | | REGION B | |
|---|---|---|---|---|---|---|---|---|
| | | | 20% OF MAX(UPSTREAM) | | 15% OF MAX(UPSTREAM) | | | |
| | POSITION OF POLE[° ] | Br [mT] | POSITION OF POLE[° ] | Br [mT] | POSITION OF POLE[° ] | Br [mT] | γ POSITION ANGLE[° ] | β POSITION ANGLE[° ] |
| N1 | 0 | 91 | | | | | | |
| S3 | 85 | 40 | | | | | | |
| S2 | 230 | 42 | 215 | 9 | 210 | 6 | 210 | 240 |
| N2 | 264 | 58 | | | | | | |
| S1 | 313 | 56 | | | | | | |

Fig. 9

DEVELOPING DEVICE

FIELD OF THE INVENTION AND RELATED ART

The present invention relates to a developing device including a supplying roller and a developing roller.

In the developing device, conventionally, one using a two-component developer containing toner comprising non-magnetic particles and a carrier comprising magnetic particles (hereinafter, the two-component developer is simply referred to as the developer) has been known. As such a developing device, a constitution using a so-called hybrid developing type including a developing roller as a rotatable developing member provided opposed to a photosensitive drum as an image bearing member and a supplying roller as a rotatable supplying member provided opposed to the developing roller has been proposed (Japanese Laid-Open Patent Application (JP-A) 2009-198582).

In the developing device using such a hybrid type, the developer is carried on the supplying roller in which a magnet is provided and a toner layer is formed on the developing roller from the developer conveyed by rotation of the supplying roller, and then an electrostatic latent image on the photosensitive drum is developed with toner supplied from the developing roller.

In the developing device disclosed in JP-A 2009-198582, the supplying roller is disposed above a feeding member for feeding the developer in the developing device. The magnet disposed inside the supplying roller includes a main pole in a position opposing the developing roller. Further, with respect to a rotational direction of the supplying roller, the magnet includes a peeling pole, disposed on a side downstream of the main pole, for peeling off the developer from the supplying roller and includes a scooping pole, disposed on a side downstream of and adjacent to the peeling pole, for scooping the developer from a developing container onto the supplying roller. Further, between the peeling pole and a scooping pole, a non-magnetic force region is provided.

Here, in the case of the constitution disclosed in JP-A 2009-198582, the developing container includes a wall member extended from a position opposing the peeling pole to below the supplying roller at a periphery of the supplying roller. For this reason, there is a liability that the developer peeled off from the supplying roller stagnates between the supplying roller and the wall member and this developer is scooped again onto the supplying roller by the scooping pole. That is, there is a liability of an occurrence of a so-called developer movement with rotation of a supplying roller such that the developer which is carried on the supplying roller and from which the toner is supplied to the developing roller is peeled off from the supplying roller and then is scooped again onto the supplying roller. When such a developer movement with rotation of the supplying roller occurs, the toner is supplied from the developer low in toner ratio, so that a quality of an output image lowers.

SUMMARY OF THE INVENTION

A principal object of the present invention is to provide a developing device including a supplying roller and a developing roller and capable of suppressing developer movement with rotation of the supplying roller.

According to an aspect of the present invention, there is provided a developing device comprising: a first chamber configured to accommodate a developer containing toner and carrier; a second chamber forming a circulation passage of the developer between itself and the first chamber; a partition wall configured to partition the first chamber and the second chamber; a first feeding screw provided in the first chamber and configured to feed the developer in a first direction; a second feeding screw provided in the second chamber and configured to feed the developer in a second direction opposite to the first direction; a developing roller configured to carry and convey the toner to a developing position where an electrostatic image formed on an image bearing member is developed; a supplying roller provided opposed to the developing roller and configured to carry and convey the developer supplied from the first chamber and to supply only the toner to the developing roller, a rotational direction of the supplying roller being opposite to a rotational direction of the developing roller in a position where the supplying roller and the developing roller oppose each other; a first magnet provided non-rotationally and fixedly inside the developing roller to and including a first magnetic pole; a second magnet provided non-rotationally and fixedly inside the supplying roller and including: a second magnetic pole which is provided opposed to the first magnetic pole in a position where the supplying roller opposes the developing roller and which is different in polarity from the first magnetic pole, a third magnetic pole provided downstream of the second magnetic pole with respect to the rotational direction of the supplying roller, and a fourth magnetic pole which is provided upstream of the second magnetic pole and downstream of and adjacent to the third magnetic pole with respect to the rotational direction of the supplying roller and which is the same in polarity as the third magnetic pole; and a guiding portion configured to guide, to the first chamber, the developer peeled off from the supplying roller by a repelling magnetic field formed by the third magnetic pole and the fourth magnetic pole, a lowermost end of the guiding portion being close to an uppermost end of the partition wall, wherein the guiding portion overlaps with the supplying roller with respect to a direction of gravitation, and wherein when: with respect to the rotational direction of the supplying roller, a position which is downstream of a position where a magnetic flux density of the third magnetic pole in a normal direction to an outer peripheral surface of the supplying roller is maximum and upstream of a position where a magnetic flux density of the fourth magnetic pole in the normal direction to the outer peripheral surface of the supplying roller is maximum and at which the magnetic flux density of the fourth magnetic pole in the normal direction is 20% of a maximum value thereof is a first position, as viewed in a cross section perpendicular to a rotational axis of the supplying roller, a position where a rectilinear line connecting the lowermost end of the guiding portion and a rotation center of the supplying roller crosses the outer peripheral surface of the supplying roller is a second position, and as viewed in the cross section perpendicular to the rotational axis of the supplying roller, a position where a rectilinear line connecting an uppermost end of the first feeding screw and the rotation center of the supplying roller crosses the outer peripheral surface of the supplying roller is a third position, with respect to the rotational direction of the supplying roller, the first position is positioned downstream of the second position and upstream of the third position.

According to another aspect of the present invention, there is provided a developing device comprising: a first chamber configured to accommodate a developer containing toner and carrier; a second chamber forming a circulation passage of the developer between itself and the first chamber; a partition wall configured to partition the first chamber and the second chamber; a first feeding screw provided in the first chamber and configured to feed the developer in a first direction; a second feeding screw provided in the second chamber and configured to feed the developer in a second direction opposite to the first direction; a developing roller configured to carry and convey the toner to a developing position where an electrostatic image formed on an image bearing member is developed; a supplying roller provided opposed to the developing roller and configured to carry and convey the developer supplied from the first chamber and to supply only the toner to the developing roller, a rotational direction of the supplying roller being opposite to a rotational direction of the developing roller in a position where the supplying roller and the developing roller oppose each other; a first magnet provided non-rotationally and fixedly inside the developing roller and including a first magnetic pole; a second magnet provided non-rotationally and fixedly inside the supplying roller and including: a second magnetic pole which is provided opposed to the first magnetic pole in a position where the supplying roller opposes the developing roller and which is different in polarity from the first magnetic pole, a third magnetic pole provided downstream of the second magnetic pole with respect to the rotational direction of the supplying roller, and a fourth magnetic pole which is provided upstream of the second magnetic pole and downstream of and adjacent to the third magnetic pole with respect to the rotational direction of the supplying roller and which is the same in polarity as the third magnetic pole; and a guiding portion configured to guide, to the first chamber, the developer peeled off from the supplying roller by a repelling magnetic field formed by the third magnetic pole and the fourth magnetic pole, a lowermost end of the guiding portion being close to an uppermost end of the partition wall, wherein the guiding portion overlaps with the supplying roller with respect to a direction of gravitation, and wherein when: with respect to the rotational direction of the supplying roller, a position which is downstream of a position where a magnetic flux density of the third magnetic pole in a normal direction to an outer peripheral surface of the supplying roller is maximum and upstream of a position where a magnetic flux density of the fourth magnetic pole in the normal direction to the outer peripheral surface of the supplying roller is maximum and at which the magnetic flux density of the fourth magnetic pole in the normal direction is 20% of an absolute value of a difference between a maximum value of the magnetic flux density of the fourth magnetic pole in the normal direction and an average of magnetic flux densities in a region where absolute values of the magnetic flux densities in the normal direction are 5 mT or less, is a first position, as viewed in a cross section perpendicular to a rotational axis of the supplying roller, a position where a rectilinear line connecting the lowermost end of the guiding portion and a rotation center of the supplying roller crosses the outer peripheral surface of the supplying roller is a second position, and as viewed in the cross section perpendicular to the rotational axis of the supplying roller, a position where a rectilinear line connecting an uppermost end of the first feeding screw and the rotation center of the supplying roller crosses the outer peripheral surface of the supplying roller is a third position, with respect to the rotational direction of the supplying roller, the first position is positioned downstream of the second position and upstream of the third position.

Further features of the present invention will become apparent from the following description of exemplary embodiments with reference to the attached drawings.

Part (a) of FIG. 6 is a table relating to a scooping magnetic force start position (scooping start magnetic force position) of a scooping pole in an embodiment 1, and part (b) of FIG. 6 is a table relating to a scooping magnetic force start position of a scooping pole in the comparison example.

Figure 7:
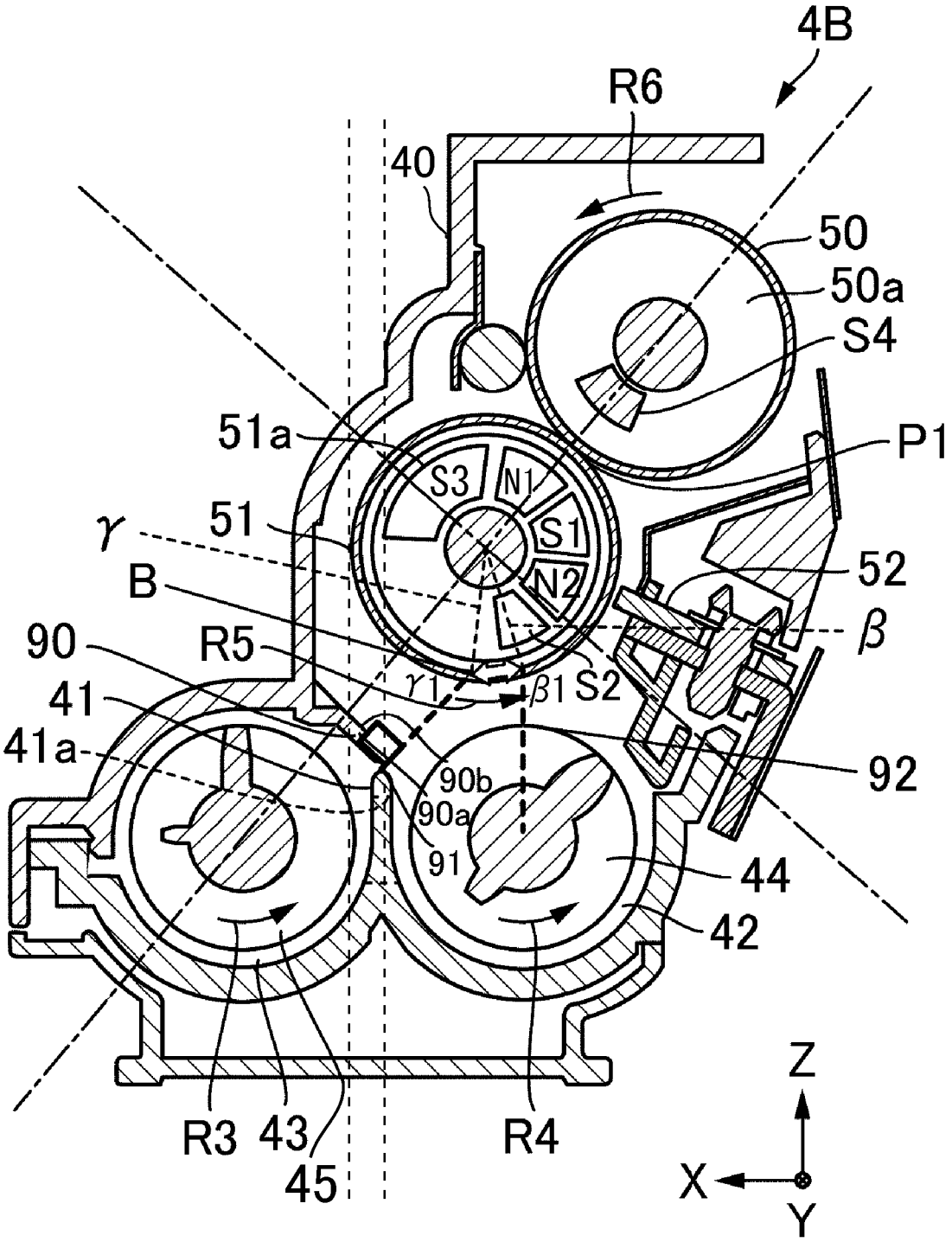

FIG. 7 is a sectional view of a developing device according to a second embodiment.

Figure 8:
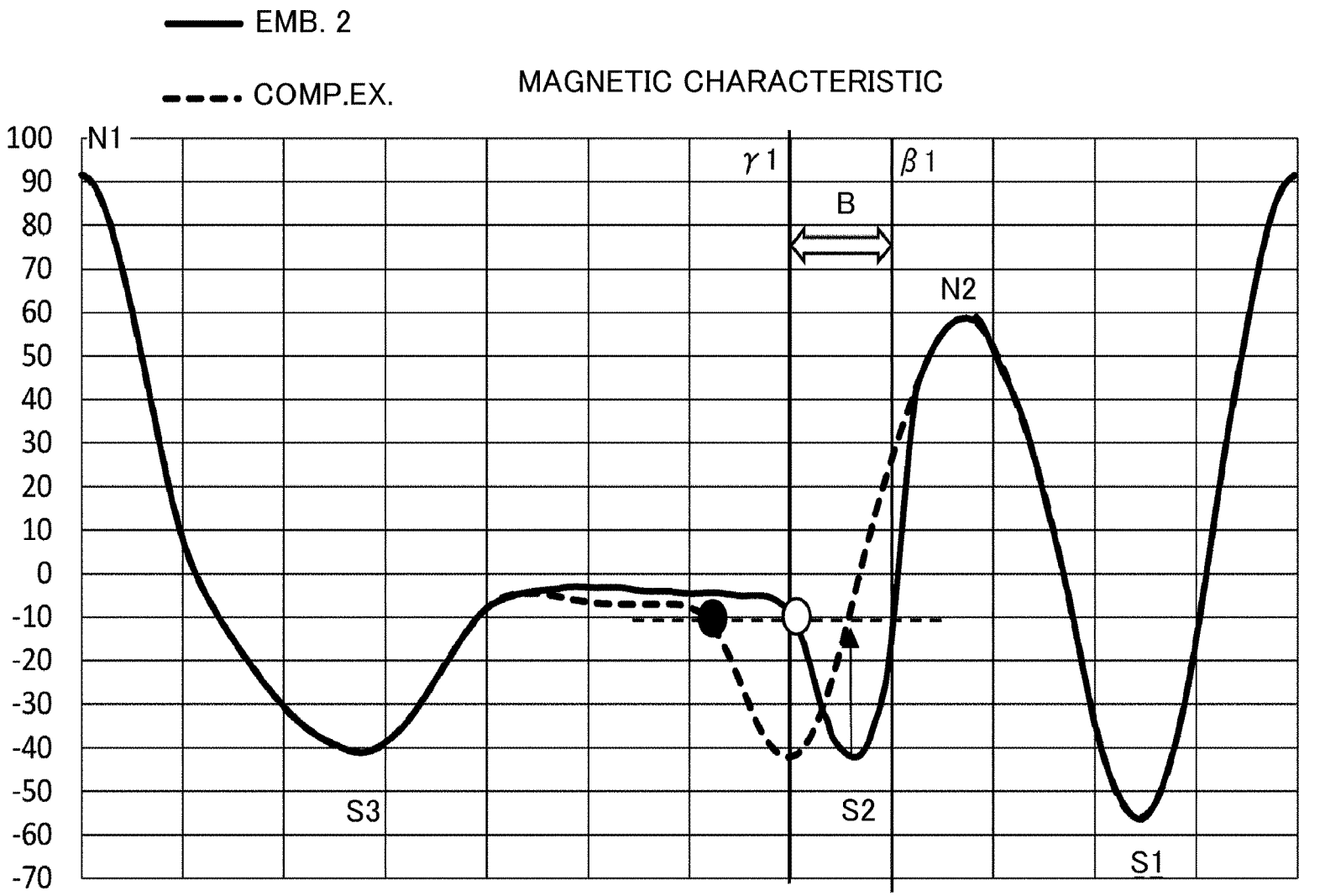

FIG. 8 is a graph showing strength of a magnetic force generated by each of magnetic poles (magnetic characteristic) when the magnetic poles of a magnet roller inside a supplying roller according to the second embodiment are developed on a flat plane.

FIG. 9 is a table relating to a scooping magnetic force start position (scooping start magnetic force position) of a scooping pole in an embodiment 2.

DESCRIPTION OF THE EMBODIMENTS

<First embodiment>

A first embodiment will be described using FIGS. 1 to 6. Incidentally, in this embodiment, the case where a developing device is applied to a full-color printer of a tandem type as an example of an image forming apparatus is described.

[Image forming apparatus]

First, a schematic structure of an image forming apparatus 100 will be described using FIG. 1.

Figure 1:
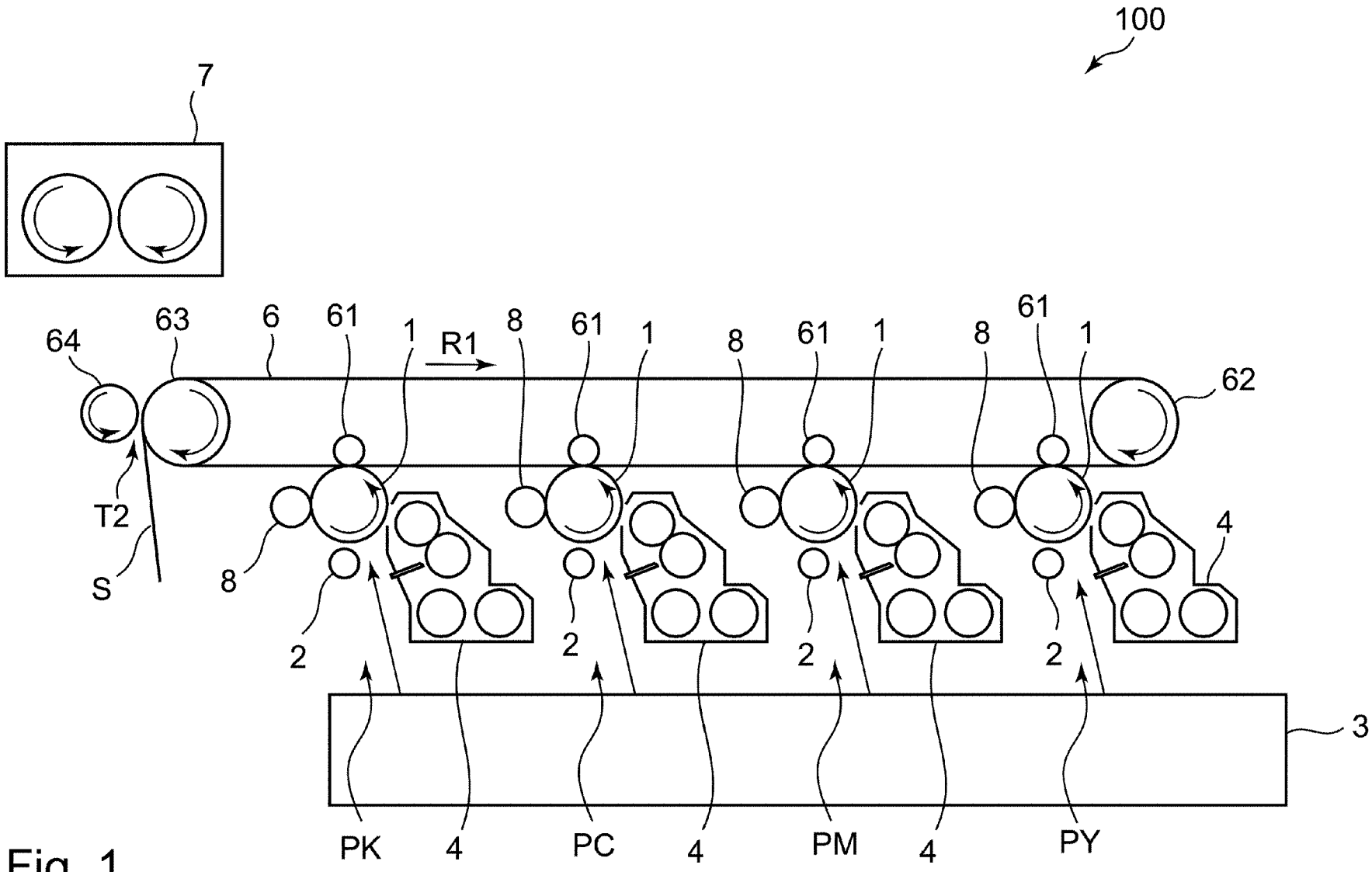
FIG. 1 is a schematic structural sectional view of an image forming apparatus in a first embodiment.

The image forming apparatus 100 shown in FIG. 1 is a full-color printer of an electrophotographic type including image forming portions PY, PM, PC and PK for four colors (yellow, magenta, cyan and black, respectively) in an apparatus main assembly. In this embodiment, an intermediary transfer tandem type in which the image forming portions PY, PM, PC, and PK are disposed along a rotational direction of an intermediary transfer belt 6 described later is employed. The image forming apparatus 100 forms a toner image (image) on a recording material S depending on an image signal from a host device such as a personal computer connected communicatably to the apparatus main assembly or to an unshown original reading device connected to the apparatus main assembly. As the recording material S, it is possible to cite a sheet material such as a sheet, a plastic film, or a cloth.

A toner image forming process will be described. First, the image forming portions PY, PM, PC and PK, will be described. The image forming portions PY, PM, PC and PK are constituted substantially the same except that colors of toners are different from each other so as to be yellow, magenta, cyan and black, respectively. Therefore, in the following, the image forming portion PY for yellow will be described as an example, and other image forming portions PM, PC and PK will be omitted from description.

The image forming portion PY is constituted principally by the photosensitive drum 1, a charging device 2, a developing device 4, a cleaning device 8, and the like. In this embodiment, the intermediary transfer belt 6 is provided above the image forming portions PY, PM, PC and PK, and an exposure device 3 is provided below the image forming portions PY, PM, PC and PK. The photosensitive drum 1 as an image bearing member and a photosensitive member includes a photosensitive layer formed on an outer peripheral surface of an aluminum cylinder so as to have a negative charge polarity or a positive charge polarity, and is rotated at a predetermined process speed (peripheral speed).

The charging device 2 electrically charges the surface of the photosensitive drum 1 to, e.g., a uniform negative or positive dark-portion potential depending on a charging characteristic of the photosensitive drum 1. In this embodiment, the charging device 2 is a charging roller rotatable in contact with the surface of the photosensitive drum 1. After the charging, at the surface of the photosensitive drum 1, an electrostatic latent image is formed on the basis of image information by the exposure device (laser scanner) 3. The photosensitive drum 1 carries the formed electrostatic image and is circulated and moved, and the electrostatic latent image is developed with the toner by the developing device 4. Details of a structure of the developing device 20 will be described later. The toner in the developer consumed by image formation is supplied together with a carrier from an unshown toner cartridge.

The toner image developed from the electrostatic latent image is supplied with a predetermined pressing force and a primary transfer bias by a primary transfer roller 61 provided opposed to the photosensitive drum 1 through the intermediary transfer belt 6, and is primary-transferred onto the intermediary transfer belt 6. The surface of the photosensitive drum 1 after the primary transfer is discharged by an unshown pre-exposure portion. The cleaning device 8 removes a residual matter such as transfer residual toner remaining on the surface of the photosensitive drum 1 after the primary transfer.

The intermediary transfer belt 6 is stretched by a stretching roller 62 and an inner secondary transfer roller 63. The intermediary transfer belt 6 is driven so as to be moved in an angle R1 direction in FIG. 1 by the inner secondary transfer roller 63 which is also driving roller. The image forming processes for the respective colors performed by the above-described image forming portions PY, PM, PC and PK are carried out at timings each when an associated color toner image is superposed on the upstream color toner image primary-transferred on the intermediary transfer belt 6 with respect to a movement direction of the intermediary transfer belt 6. As a result, finally, a full-color toner image is formed on the intermediary transfer belt 6 and is conveyed toward a secondary transfer portion T2. The secondary transfer portion T2 is a transfer nip formed by an outer secondary transfer roller 64 and a portion of the intermediary transfer belt 6 stretched by the inner secondary transfer roller 63. Incidentally, the transfer residual toner after passing through the secondary transfer portion T2 is removed from the surface of the intermediary transfer belt 6 by an unshown belt cleaning device.

Relative to the toner image forming process of the toner image sent to the secondary transfer portion T2, at a similar timing, a conveying (feeding) process of the recording material S to the secondary transfer portion T2 is executed. In this conveying process, the recording material S is fed from an unshown sheet cassette or the like and is sent to the secondary transfer portion T2 in synchronism with the image formation timing. In the secondary transfer portion T2, a secondary transfer voltage is applied to the inner secondary transfer roller 63.

By the image forming process and the conveying process which are described above, in the secondary transfer portion T2, the toner image is 20 secondary-transferred from the intermediary transfer belt 6 onto the recording material S. Thereafter, the recording material S is conveyed to a fixing device 7, and is heated and pressed by the fixing device 7, so that the toner image is melted and fixed on the recording material S. Thus, the recording material S on which the toner image is fixed is discharged on a discharge tray by a discharging roller.

[Controller]

The image forming apparatus 100 includes a controller 20 for carrying out various pieces of control such as the above-described image forming operation and the like. Operations of respective portions of the image forming apparatus 100 are controlled by the controller 20 provided in the image forming apparatus 100. A series of the image forming operations is controlled by an operating portion at an upper portion of the apparatus main assembly or by the controller 20 in accordance with respective image forming signals via a network.

Figure 2:
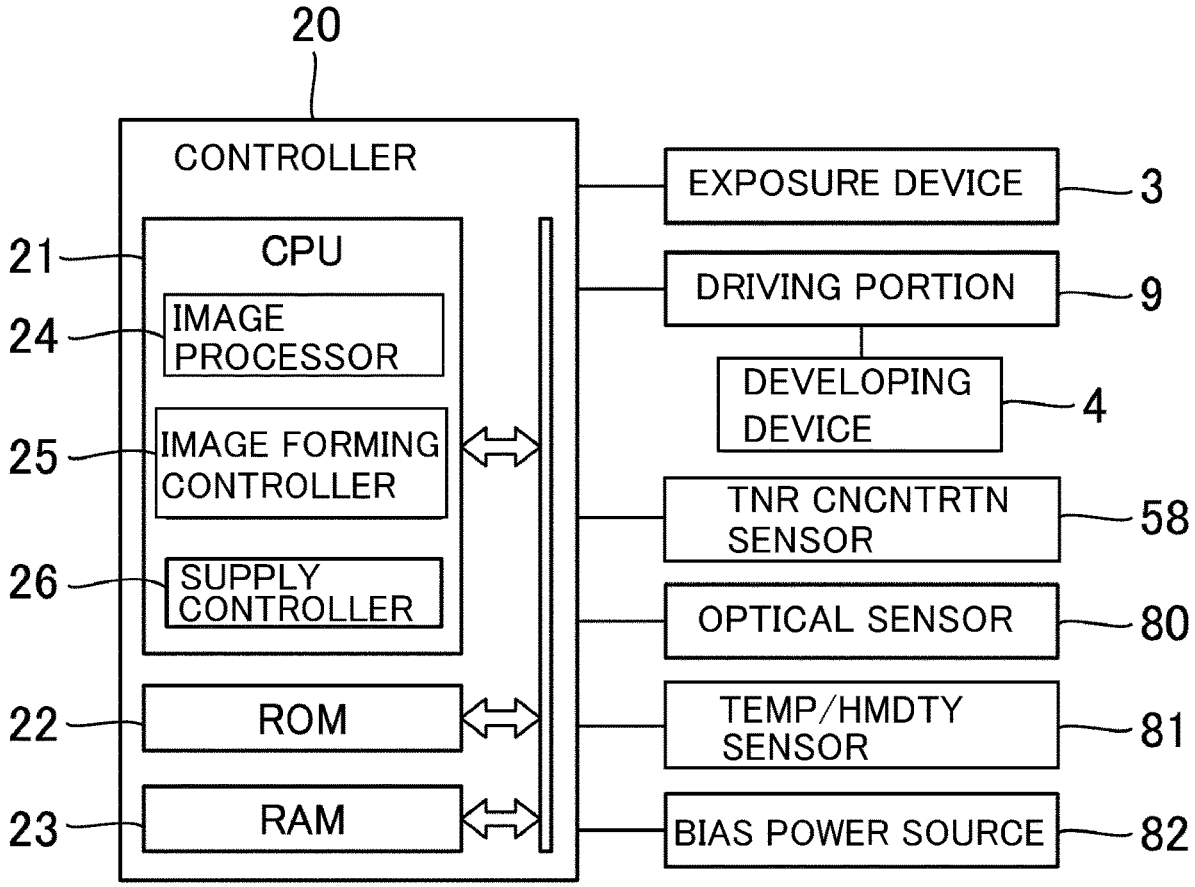
FIG. 2 is a control black diagram of the image forming apparatus in the first embodiment.

As shown in FIG. 2, the controller 20 includes a CPU (Central Processing Unit) 21 as a calculation control means, ROM (Read Only Memory) 22, a RAM (Random Access Memory) 23, and the like. The CPU 21 controls the respective portions of the image forming apparatus 100 while reading a program corresponding to a control procedure stored in the ROM 22. In the RAM 23, operation data and input data are stored, and the CPU 21 carries out control on the basis of the above-described program or the like by making reference to the data stored in the RAM 23.

The controller 20 generates driving signals of the respective portions by processing image information by an image processing portion 24 and controls the operations of the respective portions such as a driving portion 9 for driving the exposure device 3 and the developing device 4 by an image formation controller 25, and thus carries out toner supply control to the developing device 4 by the supply controller 26. The driving portion 9 includes a driving motor for driving a developing roller 50, a supplying roller 51, a first feeding screw 44, and a second feeding screw 45 which are described later.

To the controller, a toner concentration sensor 58, an optical sensor 80, a temperature and humidity sensor 81, a bias power source 82, and the like are connected. The toner concentration sensor 58 will be described later. The optical sensor 80 is disposed so as to oppose the surface of the intermediary transfer belt 6 and detects a density of a patch image which is a control toner image formed on the intermediary transfer belt 6. Depending on the density of the patch image detected by the optical sensor 80, the supply control of the toner to the developing device 4 and the like are carried out. The bias power source 82 is a power source for applying voltages to the developing roller 50 and the supplying roller 51 as described later.

The temperature and humidity sensor 81 is provided as an example of a detecting means, for example, at a part of a wall portion of a stirring chamber 43 on a downstream side of a toner conveying (feeding) direction in order to detect information on a temperature and a humidity in the developing device 4. A controller 20 calculates an absolute water content in the developing device 4 on the basis of the information, on the temperature and the humidity in the developing device 4, which is a detection result of the temperature and humidity sensor 81. That is, the temperature and humidity sensor 81 detects information on the absolute water content inside a developing container 40. Incidentally, in this embodiment, the controller 20 calculates information on a volume absolute humidity as the information on the absolute water content. Further, in this embodiment, the case where the controller 20 calculates the information on the volume absolute humidity as the information on the absolute water content was described, but the present invention is not limited to this, but the controller 20 may calculate information on a weight absolute humidity as the information on the absolute water content.

[Two-component developer]

Next, the developer used in this embodiment will be described. In this embodiment, as the developer, a two-component developer which contains non-magnetic toner particles (toner) and magnetic carrier particles (carrier) and which has a mixing coating ratio, of the toner on the carrier, of 8.0 weight % is used. The toner is colored resin particles containing a binder resin, a colorant, and other additives as desired, and onto a surface thereof, an external additive such as colloidal silica fine powder is externally added. The toner is, for example, a negatively chargeable or positively chargeable polyester resin material depending on a charging characteristic of the photosensitive drum 1 and is about 7.0 μm in volume-average particle size. The carrier comprises, for example, magnetic metal particles of, for example, iron, nickel, cobalt or the like, of which surface is oxidized, and is about 40 μm or more and about 50 μm or less in volume average particle size.

In this embodiment, as the developer, a developer including a carrier which has a weight-average particle size of 45 μm, which comprises Mn-Mg as a main component, and which has saturation magnetization of 60 emu/g as a value acquired by MSV method was used. As the toner, toner particles with an intermediate diameter of 7 μm in a volume distribution measured by a Coulter counter were used. Further, a mixture of the toner and the carrier in which a toner concentration is 12% was used as the developer.

[Developing device]

Figure 3:
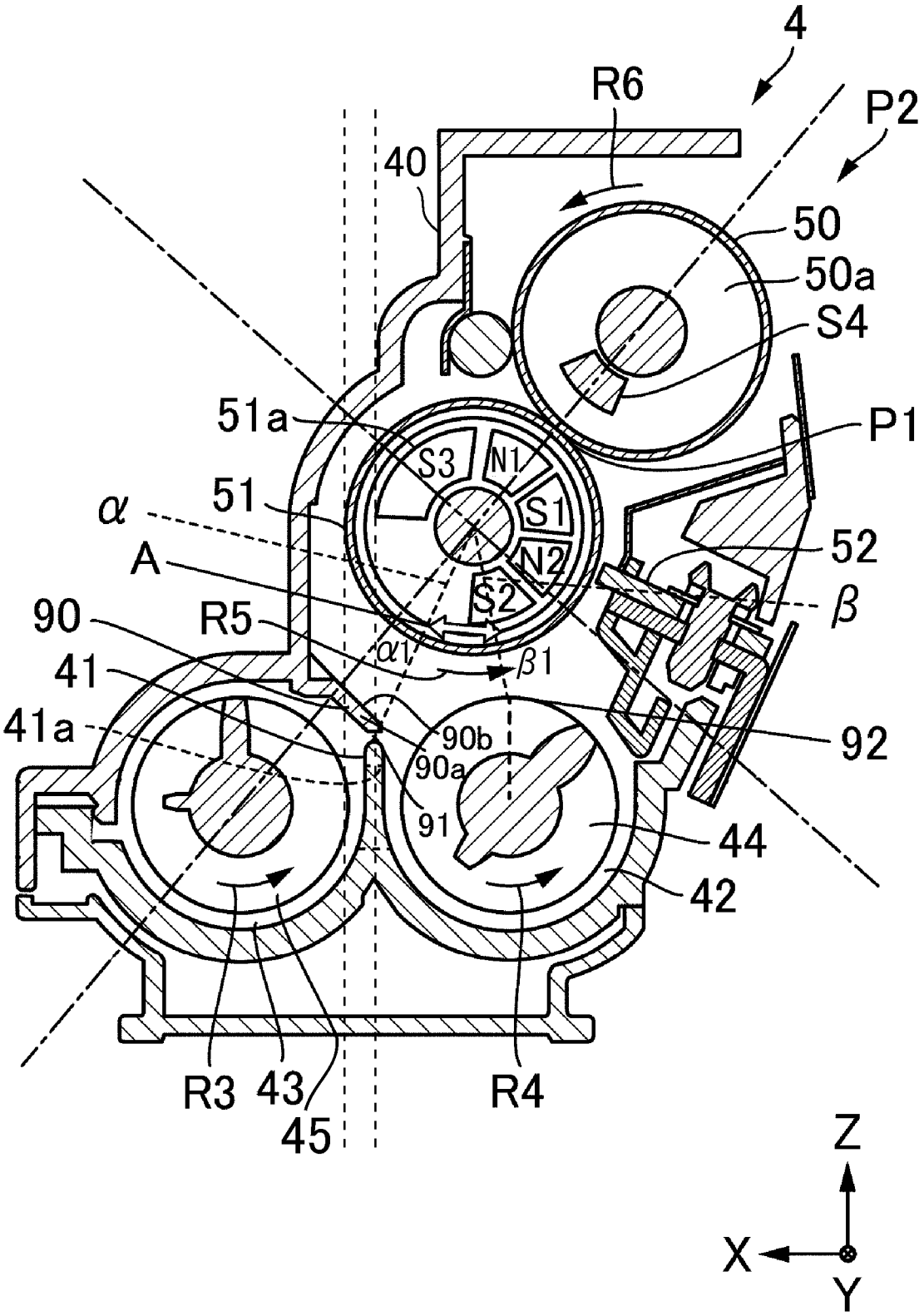
FIG. 3 is a sectional view of a developing device according to the first embodiment.

Next, the developing device 4 will be specifically described using FIG. 3. The developing device 4 of this embodiment is a developing device of a so-called touch-down developing type in which a thin layer of only the toner is formed on the developing roller 50 with a magnetic brush by the two-component developer formed on the supplying roller 51 and then development is carried out by causing the toner onto the electrostatic latent image formed on the photosensitive drum 1 by a developing bias, obtained by superimposing a DC and an AC, which is applied to the developing roller 50.

As shown in FIG. 3, the developing device 4 includes the developing container 40, the developing roller 50 as the rotatable developing member, and the supplying roller 51 as the rotatably supplying member. In the developing container 40, the developer containing the non-magnetic toner and the magnetic carrier is accommodated. The developing container 40 includes a developing chamber 42 as a first chamber, a stirring chamber 43 as a second chamber, and a partition wall 41 as a partitioning wall. The stirring chamber 43 is disposed adjacent to the developing chamber 42 so as to overlap at least partially with the developing chamber 42 as viewed in a horizontal direction. The partition wall 41 partitions between the developing chamber 42 and the stirring chamber 43. The partition wall 41 is provided with an opening 41*a* as a communicating portion for establishing communication between the developing chamber 42 and the stirring chamber 43 on each of opposite end sides with respect to a longitudinal direction (rotational axis direction of the developing roller 50 and the supplying roller 51). The developing container 40 forms a circulation passage along which the developer is circulated between the developing chamber 42 and the stirring chamber 43 via the opening 41*a* provided in the partition wall 41.

In this embodiment, the partition wall 41 is provided at a substantially central portion in the developing container 40. By this, the developing container 40 is partitioned by the partition wall 41 so that the developing chamber 42 and the stirring chamber 43 are adjacent to each other in the horizontal direction. In the developing chamber 42 and the stirring chamber 43, a first feeding screw 44 and a second feeding screw 45 which are rotatable are provided for stirring and circulating the developer.

The first feeding screw 44 as a first feeding member is disposed opposed substantially parallel to the supplying roller 51 along the rotational axis direction (longitudinal direction) of the supplying roller 51 at a bottom in the developing chamber 42 (in the first chamber). The first feeding screw 44 includes a rotation shaft 44*a* and a blade 44*b* provided helically at a periphery of the rotation shaft 44*a*. The second feeding screw 45 as a second feeding member is disposed opposed substantially parallel to the first feeding screw 44 at a bottom in the stirring chamber 43 (in the second chamber). The second feeding screw 45 includes a rotation shaft 45*a* and a blade 45*b* provided helically at a periphery of the rotation shaft 45*a*.

The first feeding screw 44 and the second feeding screw 45 are rotated in an arrow R4 direction and an arrow R3 direction, respectively, so that the developer is fed in the developing chamber 42 and the stirring chamber 43, respectively. The developer fed by rotation of the first feeding screw 44 and the second feeding screw 45 is circulated between the developing chamber 42 and the stirring chamber 43 through the opening 41*a* at each of opposite end portions of the partition wall 41. The toner is stirred by the first feeding screw 44 and the second feeding screw 45, whereby the toner is triboelectrically charged to a negative polarity or a positive polarity by friction with the carrier.

In the stirring chamber 43, the toner concentration sensor 58 (FIG. 2) is provided facing the second feeding screw 45. As the toner concentration sensor 58, for example, a permeability sensor for detecting permeability of the developer in the developing container 40 is used. On the basis of the detection result of the toner concentration sensor 58, the controller 20 causes the toner cartridge to supply the toner to the stirring chamber 43 through a toner supply opening (not shown).

As shown in FIG. 3, the developing roller 50 and the supplying roller 51 are disposed above the developing chamber 42 and the stirring chamber 43 with respect to a vertical direction. The developing roller 50 is provided obliquely on the supplying roller 51 between the supplying roller 51 and the photosensitive drum 1 as viewed in the rotational axis direction of the supplying roller 51. The supplying roller 51 and the developing roller 50 are disposed opposed to each other in an opposing portion P1 with rotational axes thereof substantially parallel to each other. The developing position 50 opposes the photosensitive drum 1 on an opening side of the developing container 40. Each of the developing roller 50 and the supplying roller 51 is provided rotatably about the rotational axis thereof. Each of the developing roller 50 and the supplying roller 51 is rotationally driven in a counterclockwise direction (arrow B6 direction or arrow R5 direction) by a driving portion 9

(FIG. 2). That is, the developing roller 50 and the supplying roller 51 are rotated in the directions opposite to each other in the opposing portion P1, and rotational speeds thereof are made variable by the driving portion 9.

The supplying roller 51 is a non-magnetic cylindrical roller (with a diameter of, for example, 20 mm or more and 25 mm or less (20 mm in this embodiment)) rotatable in the counterclockwise direction in FIG. 3, and is provided rotatably at a periphery of a non-rotational cylindrical magnet roller 51*a* which is provided on an inner peripheral side and which is a magnetic field generating means and a second magnet. That is, the magnet roller 51*a* is non-rotationally fixed and disposed inside the supplying roller 51. The magnet roller 51*a* includes 5 pieces including, on a surface thereof opposing the supplying roller 51, a scooping pole S2, a regulating pole N2, a holding pole S1, a main pole N1, and a peeling pole S3 in a named order with respect to the rotational direction of the supplying roller 51. Incidentally, in this embodiment, the magnet roller having the 5 poles is used, but a magnet roller having poles other than the 5 poles, and for example, a magnet roller having 7 poles may also be used.

The main pole N1 is disposed in a position where the supplying roller 51 opposes the developing roller 50 and is different in polarity from a receiving pole S4, described later, of the magnet roller 51*a* in the developing roller 50. The holding pole S1 is disposed upstream of and adjacent to the main pole N1 with respect to the rotational direction of the supplying roller 51 and is different in polarity from the main pole N1. The regulating pole N2 is disposed in a position which is upstream of and adjacent to the holding pole S1 and where the regulating blade 52 described later opposes the supplying roller 51, and is the same in polarity as the main pole N1. The scooping pole S2 is disposed upstream and adjacent to the regulating pole N2 and is different in polarity from the regulating pole N2, and is a magnetic pole for scooping the developer from the developing container 40 to the supplying roller 51. Specifically, the scooping pole S2 is disposed opposed to the first feeding screw 44 at an upper portion of the developing chamber 42. The peeling pole S3 is disposed upstream of and adjacent to the scooping pole S2 with respect to the rotational direction of the supplying roller 51 and is the same in polarity as the scooping pole S2. The scooping pole S2, the regulating pole N2, the holding pole S1, the main pole N1, and the peeling pole S3 are disposed adjacent to each other in a named order with respect to the rotational direction of the supplying roller 51.

The supplying roller 51 carries the developer containing the non-magnetic toner and the magnetic carrier and rotationally conveys the developer to the opposing portion P1 to the developing roller 50. That is, the supplying roller 51 is disposed opposed to the developing roller 50 and supplies the developer inside the developing container 40 to the developing roller 50. The supplying roller 51 has a cylindrical shape of, for example, 20 mm in this embodiment, and is constituted by a non-magnetic material such as aluminum or non-magnetic stainless steel, and is formed in this embodiment by aluminum. Further, the supplying roller 51 is subjected to blasting so that an outer peripheral surface thereof has surface roughness of, for example, Rz=30 μm.

The regulating blade 52 as a regulating member is disposed upstream, with respect to the rotational direction of the supplying roller 51, of a position where the supplying roller 51 opposes the developing roller 50, and regulates an amount of the developer carried on the supplying roller 51. That is, the regulating blade 52 is a plate-like member and is provided in the developing container 40 so that a free end thereof opposes the outer peripheral surface of the supplying roller 51 in which the regulating pole N2 of the magnetic roller 51*a* is disposed. A predetermined gap is provided between the free end of the regulating blade 52 and the supplying roller 51. Further, a magnetic chain of the developer carried on the surface of the supplying roller 51 is cut by the regulating blade 52, so that a layer thickness of the developer is regulated. Specifically, the regulating blade 52 comprises a metal plate (for example, stainless steel plate) disposed along the longitudinal direction of the supplying roller 51, and the developer passes through between a free end portion of the regulating blade 52 and the supplying roller 51, so that the developer is conveyed in a state in which the amount of the developer is regulated at a certain amount. The regulating blade 52 is formed in an L-shape with a magnetic member such as SUS430 with a thickness of, for example, about 1.5 mm, and is provided opposed to a position shifted in a counterclockwise direction by 3° to 5° relative to the regulating pole N2 in the case of FIG. 3, and is fixed in the developing container 40 so as to extend in the rotational axis direction of the supplying roller 51.

Incidentally, the regulating blade 52 may be either of a magnetic (material) member or a non-magnetic member (material). In the case of the magnetic material, there is an advantage such that an interval between the free end of the regulating blade 52 and the supplying roller 51 can be made large, and thus a foreign matter is not readily clogged. On the other hand, in the case of the magnetic material, there is a liability that the developer is constrained by the magnetic field between the free end potion of the regulating blade 52 and the supplying roller 51 and thus a developer deterioration due to friction is liable to occur. Incidentally, a constitution in which the regulating blade 52 is a magnetic member which is applied to a part of the non-magnetic member may be employed. By doing so, the advantage of the magnetic member is somewhat lost, but it is possible to suppress the developer deterioration. In this embodiment, as the regulating blade 52, a regulating blade consisting only of a magnetic member was used. For that reason, there is a liability of the developer deterioration, but it becomes possible to suppress the developer deterioration by using the magnet roller 51*a* described later in this embodiment in combination.

The developer accommodated in the developing chamber 42 is attracted to the surface of the supplying roller 51 by the scooping magnetic pole S2 opposing the supplying roller 51 and is conveyed toward the regulating blade 52. The developer is erected by the regulating magnetic pole N2 opposing the regulating blade 52, and a layer thickness thereof is regulated by the regulating blade 52. The developer layer passes through the holding pole S1, and is carried and conveyed to the opposing the photosensitive drum 1 and then supplies the toner to the surface of the developing roller 50 in a state in which the magnetic chains are formed by the main pole N1 opposing the developing region. To the supplying roller 51, a supplying bias in the form of superimposition of a DC voltage and an AC voltage is applied.

The developing roller 50 is disposed opposed to the photosensitive drum 1 and conveys the developer to a developing position where the electrostatic latent image formed on the photosensitive drum 1 is developed by rotation of the developing roller 50. That is, the developing roller 50 is a non-magnetic roller rotatable in the counterclockwise direction in FIG. 3 and is provided rotatably around the magnet roller 50*a* as a first magnet which includes a single receiving pole S4 provided on an inner peripheral surface side and which does not rotate. The developing roller 50 is capable of developing the electrostatic latent image on the photosensitive drum 1 in the developing region which is an opposing region to the photosensitive drum 1 by being rotated while carrying the toner. The supplying roller 51 and the developing roller 50 oppose each other in the opposing portion P1 with a predetermined gap. The receiving pole S4 of the magnet roller 50*a* of the developing roller 50 is different in polarity from the main pole N1 opposing the receiving pole S4.

To the developing roller 50, a developing bias in the form of superimposition of a DV voltage and an AC voltage is applied. The developing bias and the supplying bias are applied from a bias power source 82 (FIG. 2) as an example of a voltage applying portion to the developing roller 50 and the supplying roller 51, respectively through a bias control circuit.

That is, the bias power source 82 applies a voltage including a DC component and an AC component to between the developing roller 50 and the supplying roller 51.

Toner remaining on the developing roller 50 without being used for the development is conveyed again to the opposing portion P1 between the developing roller 50 and the supplying roller 51 and is rubbed with the magnetic chains on the supplying roller 51, thus being collected by the supplying roller 51. The magnetic chains are peeled off from the supplying roller 51 in a peeling region formed by repulsion of the peeling pole S3 and the scooping pole S3 which are disposed on the downstream side of the rotational direction of the supplying roller 51. The developer peeled off falls in the developing chamber 42, and is stirred and fed together with the developer circulated inside the developing chamber 40 and is attracted to the scooping pole S2 again, and then is conveyed by the supplying roller 51.

[Relationship between magnet roller of supplying roller and developing container]

Next, a relationship between the developing container 40 of the developing device 4 of this embodiment and the magnet roller 51*a* of the supplying roller 51 will be described. Incidentally, in the following description, "upstream" and "downstream" which are simply mentioned refer to "upstream" and "downstream", respectively, with respect to the rotational direction of the supplying roller 51.

As shown in FIG. 3, the developing container 40 includes a wall member 90 extended from a position opposing the peeling pole S3 to below the supplying roller 51 at a periphery of the supplying roller 51. The wall member 90 is extended to a position opposing a low magnetic force region (region in which an absolute value of the magnetic flux density Br which is a normal direction component of the magnetic flux density Br at the surface of the supplying roller 51 is 5 mT or less) disposed between a portion downstream of the peeling pole S3 and a portion upstream of the scooping pole S2 with respect to the rotational direction of the supplying roller 51. Specifically, the wall member 90 is extended to between the supplying roller 51 and the second feeding screw 45 in the stirring chamber 43, and a free end thereof is close to an upper end of the partition wall 41. That is, as shown in FIG. 3, the partition wall 41 overlaps with the supplying roller 51 with respect to a direction of gravitation (Z direction), and the wall member 90 overlaps with the supplying roller 51 with respect to the direction of gravitation (Z direction).

Further, of the wall member 90, a portion extended from a portion constituting an outer wall of the developing container 40 toward the upper end of the partition wall 41 is referred to as an extended portion 90*a*. In the extended portion 90*a*, a flat surface portion 90*b* opposing the supplying roller 51 between the second feeding screw 45 and the supplying roller 51 is formed so as to reach at least a most downstream position of the wall member 90 with respect to the supplying roller 51. That is, the extended portion 90*a* includes, as a flat surface, a surface opposing the supplying roller 51 in a region from a position, on a side downstream of a connecting portion with the portion constituting the outer wall of the developing container 40, to the free end of the extended portion 90*a* with respect to the rotational direction of the supplying roller 51. However, in this embodiment, this surface may be formed as a curved surface recessed as viewed from the supplying roller 51 side or a curved surface recessed as viewed from the second feeding screw 45 side.

As described above, when the supplying roller 51 is rotated counterclockwise from the peeling pole S3, in the low magnetic force region disposed on a side downstream of the peeling pole S3 with respect to the rotational direction of the supplying roller 51, the magnetic brush, i.e., the developer is peeled off from the supplying roller 51. The peeled developer gradually falls from the supplying roller 51 in a vertically downward direction between the supplying roller 51 and the wall member 90 of the developing container 40 in a position opposing the supplying roller 51 by a rotating force of the supplying roller and the direction of gravitation when the developer is peeled off from the supplying roller 51.

Thus, the developer peeled off from the supplying roller 51 falls onto the flat surface portion 90*b* of the wall member 90 and thereafter is guided into the developing chamber 42 through the flat surface portion 90*b* of the wall member 90, so that the developer is collected by the first feeding screw 44 and is stirred with the developer in the developing chamber 42. However, the developer peeled off from the supplying roller 51 falls onto the extended portion 90*a* of the wall member 90 positioned above the second feeding screw 45 earlier than the developer is collected by the first feeding screw 44, and is stored in a region between the supplying roller 51 and the extended portion 90*a*.

Figure 4:
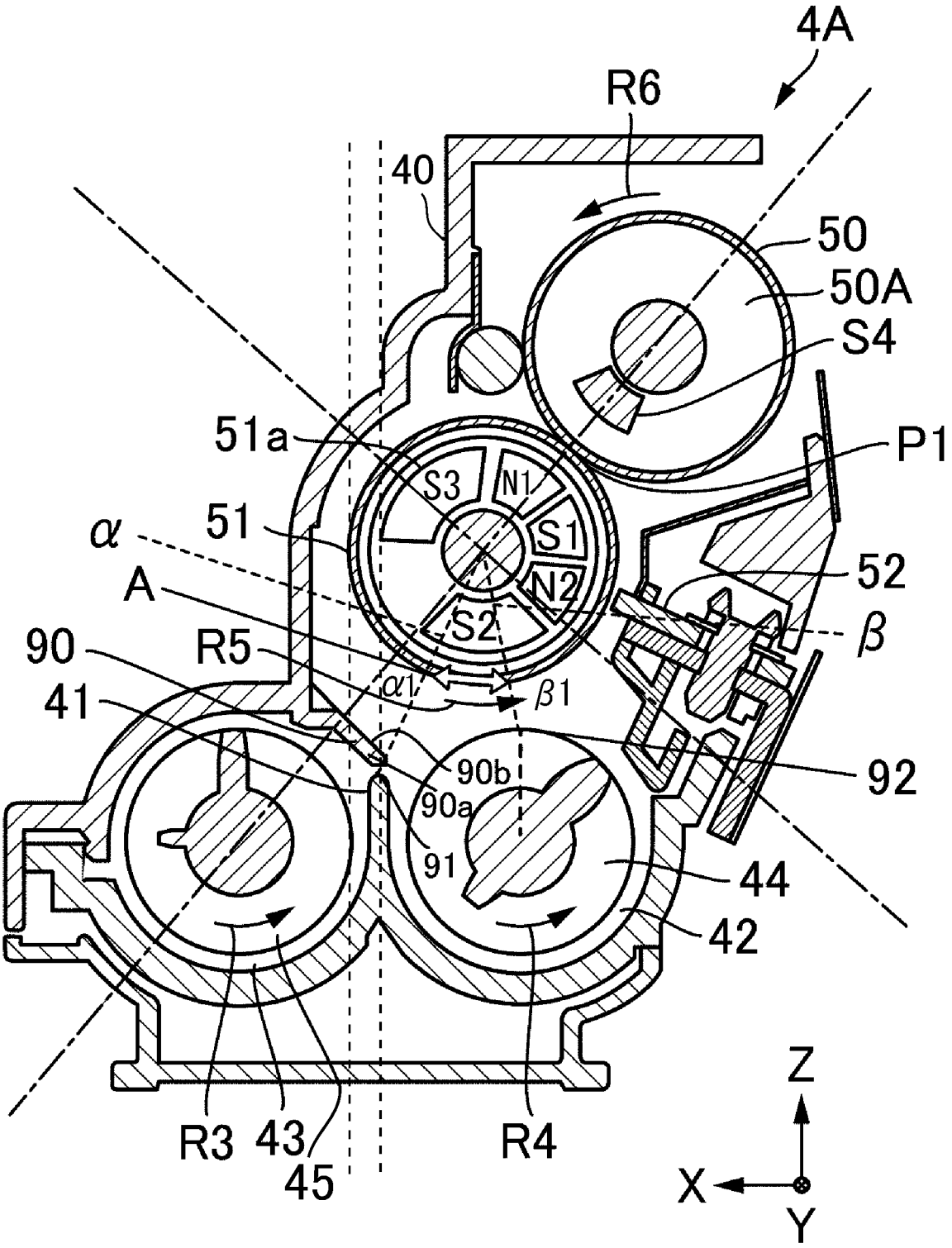
FIG. 4 is a sectional view of a developing device according to a comparison example.

Here, as in the developing device 4A of the comparison example shown in FIG. 4, when the magnetic force of the scooping pole S2 extends to a position opposing the extended portion 90*a* of the wall member 90, the developer on the extended portion 90*a* is attracted again to the supplying roller 51. That is, the so-called developer movement with rotation of the supplying roller 51 such that the developer which is carried on the supplying roller 51 and from which the toner is supplied to the developing roller 50 is peeled off from the supplying roller 51 and thereafter is scooped again onto the supplying roller 51 occurs. A constitution of the comparison example shown in FIG. 4 is the same as the constitution of FIG. 3 except that a width of a piece of the scooping pole S2 with respect to the rotational direction of the supplying roller 51 extends toward an upstream side more than in the constitution of FIG. 3.

When a position of an upstream end, with respect to the rotational direction of the supplying roller 51, of a region on which the magnetic force of the scooping pole S2 has the influence is taken as a scooping magnetic force start position (scooping start magnetic force position), in order to prevent the developer on the extended portion 90*a* from being attracted again to the supplying roller 51 by the scooping pole S2, the scooping magnetic force start position may preferably be positioned downstream of a line connecting the most downstream position 91 of the wall member 90 and a rotation center position of the supplying roller 51. The most downstream position 91 is also a most downstream position of the extended portion 90*a*. In the case of this embodiment, the most downstream position 91 is a point of intersection between the extended portion 90*a* of the wall member 90 positioned above the second feeding screw 45 and the partition wall 41 between the first feeding screw 44 and the second feeding screw 45.

In the case where the line connecting the most downstream position 91 of the wall member 90 and the rotation center position of the supplying roller 51 is taken as a phantom line α, when a magnetic force for attracting the developer to the supplying roller 51 by the scooping pole S2 exists in a region upstream of this phantom line a with respect to the rotational direction of the supplying roller 51, the magnetic force attracts the developer on the extended portion 90*a* of the wall member 90 to the supplying roller 51. In the case of the comparison example of FIG. 4, the upstream end of the piece of the scooping pole S2 is positioned further upstream of the phantom line α, so that the scooping magnetic force start position is positioned upstream of the phantom line α. Accordingly, as described above, in the case of the constitution of the comparison example, there is a liability that the developer movement with rotation of the supplying roller 51 occurs.

Accordingly, in this embodiment, on the side downstream of the phantom line α connecting the most downstream position 91 of the wall member and the rotation center position of the supplying roller 51, with respect to the rotational direction of the supplying roller 51, the region on which the magnetic force of the scooping pole S2 has the influence is disposed. That is, with respect to the rotational direction of the supplying roller 51, the scooping pole S2 is disposed so that the scooping magnetic force start position is positioned downstream of a position α1 where the line (phantom line α) connecting the most downstream position 91 of the wall member 90 crosses the surface of the supplying roller 51.

On the other hand, when the scooping magnetic force start position of the scooping pole S2 is excessively moved to the downstream side of the rotational direction of the supplying roller 51, the developer in the developing chamber 42 cannot be scooped by the magnetic force of the scooping pole S2. In order to stably scoop the developer by the scooping pole S2, it is desirable that the magnetic force of the scooping pole S2 has the influence sufficiently on a region where a height of the developer surface on the first feeding screw 44 is highest.

The present inventor confirmed that a developer scooping property is stabilized when the magnetic force of the scooping pole S2 contributes to a highest position 92 with respect to a height direction during rotation of the first feeding screw 44. Therefore, in this embodiment, with respect to the rotational direction of the supplying roller 51, the scooping magnetic force start position is positioned upstream of the highest position 92 with respect to the vertical direction of the blade 44*b* of the first feeding screw 44. That is, relative to a position β1 where a phantom line β connecting the highest position 92 of the first feeding screw 44 and the rotation center position of the supplying roller 51 crosses the surface of the supplying roller 51, the scooping magnetic force start position is disposed on a side upstream of the position β1, so that the developer scooping property of the supplying roller 51 is stabilized.

A region, with respect to the rotational direction of the supplying roller 51, between the phantom line α connecting the most downstream position 91 of the wall member 90 and the rotation center position of the supplying roller 51 and the phantom line β connecting the highest position 92 of the first feeding screw 44 and the rotation center position of the supplying roller 51 is taken as a region A. In this case, in this embodiment, the scooping magnetic force start position by the scooping pole S2 is disposed in the region A. Specifically, as shown in FIG. 3, with respect to the rotational direction of the supplying roller 51, the upstream end of the piece of the scooping pole S2 is positioned within the region A. By this, the developer movement with rotation of the supplying roller 51 of the developer peeled off in the downstream low magnetic force region by the peeling pole S3 can be suppressed, and in addition, the scooping property of the developer from the developing chamber 42 can be stabilized.

Figure 5:
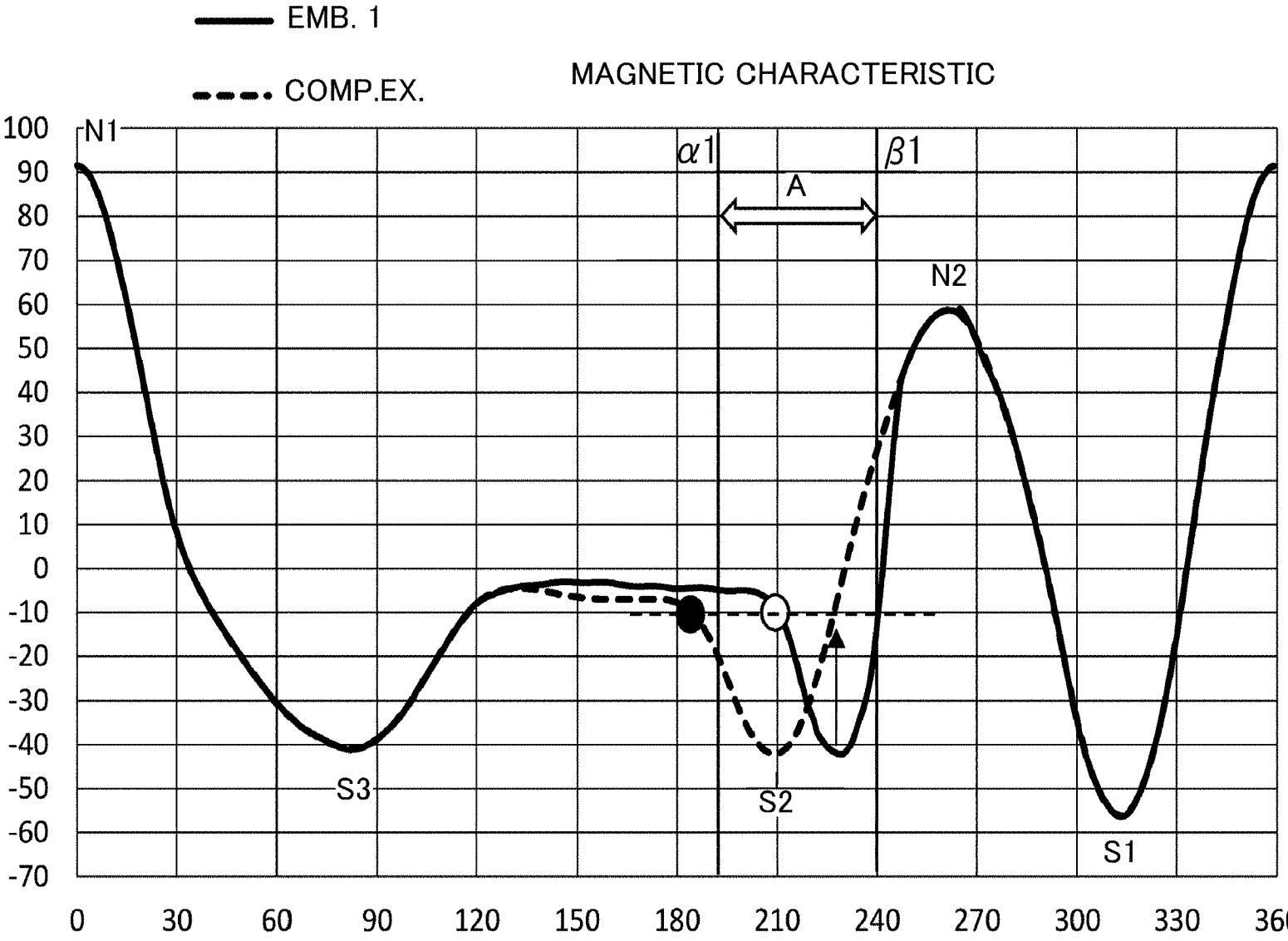
FIG. 5 is a graph showing strength of a magnetic force generated by each of magnetic poles (magnetic characteristic) when the magnetic poles of a magnet roller inside a supplying roller according to each of the first embodiment and the comparison example are developed on a flat plane.

FIG. 5 is a graph showing a strength of the magnetic force (magnitude of the magnetic flux density Br) generated by each of magnetic poles when the magnetic poles of the magnet roller 51*a* incorporated in the supplying roller 51 in the developing device 4 shown in FIG. 3 are developed on a flat plane.

Incidentally, the magnetic flux density Br accurately refers to a normal direction component of a magnetic flux density B normal to the surface of the supplying roller 51. Hereinafter, the "magnetic flux density Br in the normal direction" is simply called the "magnetic flux density" or the "magnetic force" in some cases. In the case where the magnetic flux density is simply called the "magnetic flux density" or the "magnetic force", the magnetic flux density or the magnetic force refers to the "magnetic flux density Br in the normal direction". The magnetic flux density Br of each of the magnet rollers (with respect to the normal direction) in the embodiment 1 and in the comparison example 1 was measured using a magnetic field measuring device ("MS-9902", manufactured by F.W. BELL) in which a distance between a probe which is a member of the magnetic field measuring device and the surface of the supplying roller 51 is of about 100 μm.

Further, in the graph of FIG. 5, the abscissa represents an angle (unit: deg) when the clockwise direction from a closest position)(0° where the supplying roller 51 opposes the developing roller 50 is taken as a positive direction. The ordinate represents the magnitude (unit: mT) of the magnetic flux density Br, in which the magnitude shows a positive value on an N-pole side and shows a negative value on an S-pole side. Further, N1, S3, S2, N2 and S1 represent positions (maximum value positions) of the associated magnetic poles of the magnet roller 51*a* in the supplying roller 51. That is, each of N1, S3, S2, N2 and S1 is a position where the magnetic flux density Br (normal direction component of the magnetic flux density B at the surface of the supplying roller 51) of the associated magnetic pole of the magnet roller 51*a* in the supplying roller 51 becomes a maximum value (largest value).

Further, a line indicated by a shows a position of the phantom line a connecting the most downstream position 91 of the wall member 90 and the rotation center position of the supplying roller 51 as described with reference to FIG. 3. In FIG. 5, the position of the phantom line a is a position of 195° in the counterclockwise direction from the closest position where the supplying roller 51 opposes the developing roller 50.

Further, a line indicated by β shows a position of the phantom line β connecting the highest position 92 of the first feeding screw 44 and the rotation center position of the supplying roller 51 as described with reference to FIG. 3. In FIG. 5, the position of the phantom line α is a position of 240° in the counterclockwise direction from the closest position where the supplying roller 51 opposes the developing roller 50. In FIG. 5, a magnetic characteristic of a developing device of an embodiment 1 in which the condition of this embodiment described with reference to FIG. 3 is satisfied is indicated by a solid line, and a magnetic characteristic of a developing device of a comparison example described with reference to FIG. 4 is indicated by a broken line.

Next, description will be made as to that the scooping magnetic force start position is set where in the magnetic characteristic. In this case, a position where an absolute value of the magnetic flux density Br of the scooping pole S2 in the normal direction at the surface of the supplying roller 51 is 20% of a maximum value (largest value) thereof on a side downstream of the peeling pole S3. In the case where the magnitude of the magnetic flux density Br in the scooping magnetic force start position is made a value with a ratio lower than 15% of the maximum value (largest value) of the magnetic flux density Br of the scooping pole S2, the magnitude of the magnetic flux density Br becomes about 5 mT relative to the scooping pole S2 of 40 mT to 50 mT in magnitude of the magnetic flux density Br. For this reason, the magnitude of the magnetic flux density Br is unchanged from the magnitude of the magnetic flux density Br in the low magnetic force region, so that it is hard to define that contribution of the magnetic force of the scooping pole S2 starts from which position. For this reason, in this embodiment, the scooping magnetic force start position was set at a position where the absolute value of the magnetic flux density Br of the scooping pole S2 in the normal direction at the surface of the supplying roller 51 becomes 20% of the maximum value (largest value) thereof on the side downstream of the peeling pole S3. Incidentally, in this embodiment, the scooping magnetic force start position was set at the position where the absolute value of the magnetic flux density Br of the scooping pole S2 in the normal direction at the surface of the supplying roller 51 becomes 20% of the maximum value (largest value) thereof, but the present invention is not limited thereto. Depending on an environment or the like, scooping of the developer onto the surface of the supplying roller 51 is started in some instances from a position where the absolute value of the magnetic flux density Br of the scooping pole S2 in the normal direction at the surface of the supplying roller 51 becomes 15% of the maximum value (largest value) thereof. Therefore, in order to further enhance an effect of suppressing the developer movement in the rotation of the supplying roller 51, it is preferable that the scooping magnetic force start position is set at the position where the absolute value of the magnetic flux density Br of the scooping pole S2 in the normal direction at the surface of the supplying roller 51 becomes 15% of the maximum value (largest value) thereof and then the most downstream position 91 of the wall member 90 is designed.

In FIG. 5, in the case where the scooping magnetic force start position is set at the position where the absolute value of the magnetic flux density Br of the scooping pole S2 becomes 20% of the maximum value (largest value) thereof, the scooping magnetic force start position in the embodiment 1 is indicated by a white circle, and the scooping magnetic force start position in the comparison example is indicated by a black circle (dot). As described above, the phantom line α connecting the most downstream position 91 of the wall member 90 and the rotation center position of the supplying roller 51 is a line showing the magnetic characteristic having the influence on the developer movement of the rotation of the supplying roller 51. As is apparent from FIG. 5, the position of the black circle indicating the scooping magnetic force start position in the comparison example is positioned on a side upstream of the phantom line α with respect to the rotational direction of the supplying roller 51. On the other hand, the position of the white circle indicating the scooping magnetic force start position in the embodiment 1 is positioned on a side downstream of the phantom line α with respect to the rotational direction of the supplying roller 51.

Part (a) of FIG. 6 shows angles of poles [deg] of respective magnetic poles and magnitudes of maximum values (largest values) of the magnetic flux density Br of the respective magnetic poles in the embodiment 1, and shows magnetic characteristic values [mT] and angles [deg] of the scooping (scooping start magnetic force position) for the scooping pole S2 in the embodiment 1. In addition, angles [deg] of the phantom lines α and α are also shown. Part (b) of FIG. 6 shows angles of poles [deg] of the respective magnetic poles and magnitudes of maximum values (largest values) of the magnetic flux density Br of the respective magnetic poles in the comparison example, and shows magnetic characteristic values [mT] and angles [deg] of the scooping magnetic force start position for the scooping pole S2 in the comparison example.

In the case of this embodiment having the above-described constitution, the occurrence of the developer movement with rotation of the supplying roller 51 after the toner on the supplying roller 51 is consumed by being moved to the developing roller 50, and different from the comparison example, an occurrence of an inconvenience such that an image density lowers with progression of image formation can be suppressed.

<Second embodiment>

A second embodiment will be described using FIGS. 7 to 9. In this embodiment, a scooping magnetic force start position is made different from the first embodiment. Other constitutions and actions are similar to those in the first embodiment, and therefore, the similar constitutions are omitted from description and illustration or briefly described by adding the same reference numerals or symbols, and in the following, a difference from the first embodiment will be principally described.

In the first embodiment, with respect to the rotational direction of the supplying roller 51, the scooping pole S2 is disposed so that the scooping magnetic force start position is developed downstream of the position α1 where the line (phantom line α) connecting the most downstream position 91 of the wall member 90 and the rotation center position of the supplying roller 51 crosses the surface of the supplying roller 51. Thus, the developer movement with rotation of the supplying roller 51 of the developer stored in the region between the wall member 90 and the supplying roller 51 is suppressed.

However, as regards the developer movement with rotation of the supplying roller 51, the scooping pole S2 attracts not only the developer stored between the wall member 90 and the supplying roller 51 but also the developer floating between the wall member 90 and the supplying roller 51. Also, a developing device 4B of this embodiment is rotated counterclockwise similarly as in the first embodiment, but at that time, between the wall member 90 and the developing container 40 opposing the supplying roller 51, an airflow generated by rotation of the supplying roller 51 is caused. By the influence of this airflow, the developer peeled off in the low magnetic force region positioned downstream of the peeling pole S3 flows along a space between the supplying roller 51 and the developing container 40 while floating between the supplying roller 51 and the developing container 40. Then, the developer is carried until this space reaches a region positioned above the first feeding screw 44.

In the constitution of this embodiment, the developer floats to the most downstream position 91 (position of the point of intersection with the downstream 41) of the wall member 90. Then, when the airflow passes through this position, the developer is taken in by the first feeding screw 44, and therefore, influence of the floating developer is suppressed. Accordingly, when the floating developer is attracted to the scooping pole S2 before passing through this position, there is a liability that the developer movement with rotation of the supplying roller 51 occurs more or less.

In this embodiment, a space in which the floating developer due to such an airflow exists is considered as a region to a position where a perpendicular line is drawn from the most downstream position 91 of the wall member 90 toward the supplying roller 51, and as described below, a relationship thereof with the scooping magnetic force start position is defined. Incidentally, in this embodiment, as shown in FIG. 7, the partition wall 41 overlaps with the supplying roller 51 with respect to the direction of gravitation (Z direction), and the wall member 90 overlaps with the supplying roller 51 with respect to the direction of gravitation (Z direction). Further, the extended portion 90*a* of the wall member 90 is formed so that the flat surface portion 90*b* opposing the supplying roller 51 between the second feeding screw 45 and the supplying roller 51 at least reaches the most downstream position 91 of the wall member 90 with respect to the rotational direction of the supplying roller 51. That is, the extended portion 90*a* includes, as a flat surface, a surface opposing the supplying roller 51 from a position, on a side downstream of a connecting portion to a portion constituting the outer wall of the developing container 40 with respect to the rotational direction of the supplying roller 51, to a free end thereof.

In this embodiment as described above, as shown in FIG. 7, a perpendicular line γ to the flat surface portion 90*b* of the wall member 90 is drawn from the most downstream position 91 of the wall member 90 toward the surface of the supplying roller 51. A position where this perpendicular line γ crosses the surface of the supplying roller 51 is taken as a position γ1. Further, the scooping pole S2 is disposed so that the scooping magnetic force start position is positioned downstream of the position γ1.

That is, in this embodiment, in the most downstream position 91 of the wall member 90 with respect to the rotational direction of the supplying roller 51, the position γ1 on the supplying roller 51 when a line is drawn toward the supplying roller 51 in the perpendicular direction is used as a position for discriminating whether or not the developer movement by the airflow occurs. Further, by disposing the scooping magnetic force start position of the scooping pole S2 on a side downstream of the position γ1 with respect to the rotational direction of the supplying roller 51, re-attraction of the developer floating between the supplying roller 51 and each of the developing container 40 and the wall member 90 to the scooping pole S2 before the developer is collected by the first feeding screw 44 is suppressed.

Also, in the case of this embodiment, similar as in the first embodiment, the position where the absolute value of the magnetic flux density Br of the scooping pole S2 in the normal direction at the surface of the supplying roller S3 becomes 20% (preferably 15%) on the side downstream of the peeling pole S3 is taken as the scooping magnetic force start position. Further, similarly as in the first embodiment, the scooping magnetic force start position is disposed on the side upstream, with respect to the rotational direction of the supplying roller 51, of the position β1 where the phantom line β connecting the highest position 92 of the first feeding screw 44 and the rotation center position of the supplying roller 51 crosses the surface of the supplying roller 51.

Here, a region, with respect to the rotational direction of the supplying roller 51, between the perpendicular line γ and the phantom line β is taken as a region B. In this case, in this embodiment, the scooping magnetic force start position by the scooping pole S2 is disposed in the region B. Specifically, as shown in FIG. 7, with respect to the rotational direction of the supplying roller 51, the upstream end of the piece of the scooping pole S2 is positioned within the region B. By this, the developer movement with rotation of the supplying roller 51 of the developer peeled off in the downstream low magnetic force region by the peeling pole S3 can be further suppressed, and in addition, the scooping property of the developer from the developing chamber 42 can be stabilized.

FIG. 8 is a graph showing a strength of the magnetic force (magnitude of the magnetic flux density Br) generated by each of magnetic poles when the magnetic poles of the magnet roller 51*a* incorporated in the supplying roller 51 in the developing device 4 shown in FIG. 7 are developed on a flat plane. The graph of FIG. 8 is similar to the graph of FIG. 5, in which a magnetic characteristic of a developing device of an embodiment 2 in which the condition of this embodiment described with reference to FIG. 7 is satisfied is indicated by a solid line, and the magnetic characteristic of the developing device of the comparison example described with reference to FIG. 4 is indicated by the broken line. Further, a line indicated by a symbol γ is the perpendicular line γ, to the flat surface portion 90*b* of the wall member 90, drawn from the most downstream position 91 of the wall member 90 toward the surface of the supplying roller 51 as described above with a reference to FIG. 7.

In FIG. 8, in the case where the scooping magnetic force start position is set at the position where the absolute value of the magnetic flux density Br of the scooping pole S2 becomes 20% of the maximum value (largest value) thereof, the scooping magnetic force start position in the embodiment 1 is indicated by a white circle, and the scooping magnetic force start position in the comparison example is indicated by a black circle (dot). As described above, the perpendicular line γ drawn from the most downstream position 91 toward the supplying roller 51 is a line showing the magnetic characteristic having the influence on the developer movement of the rotation of the supplying roller 51. As is apparent from FIG. 8, the position of the black circle indicating the scooping magnetic force start position in the comparison example is positioned on a side upstream of the perpendicular line γ with respect to the rotational direction of the supplying roller 51. On the other hand, the position of the white circle indicating the scooping magnetic force start position in the embodiment 2 is positioned on a side downstream of the perpendicular line γ with respect to the rotational direction of the supplying roller 51.

FIG. 9 shows angles of poles [deg] of respective magnetic poles and magnitudes of maximum values (largest values) of the magnetic flux density Br of the respective magnetic poles in the embodiment 2, and shows magnetic characteristic values [mT] and angles [deg] of the scooping (scooping start magnetic force position) for the scooping pole S2 in the embodiment 2. In addition, angles [deg] of the perpendicular line γ and the phantom line β are also shown. Incidentally, as is understood from comparisons between FIG. 9 and FIG. 9 and between FIG. 5 and part (a) of FIG. 6, the magnet roller 51*a* of the supplying roller 51 in the embodiment 2 uses the same constitution as the constitution of the magnet roller 51*a* of the supplying roller 51 in the embodiment 1.

In the case of this embodiment having the above-described constitution, similarly as in the first embodiment, the occurrence of the developer movement with rotation of the supplying roller 51 after the toner on the supplying roller 51 is consumed by being moved to the developing roller 50, and different from the comparison example, an occurrence of an inconvenience such that an image density lowers with progression of image formation can be suppressed. Particularly, when the scooping magnetic force start position is defined as in this embodiment, the developer movement with rotation of the supplying roller 51 of the developer floating due to the airflow generated by rotation of the supplying roller 51 can be effectively suppressed. For this reason, a lowering in density when many images are formed by the image forming apparatus can be suppressed more than in the constitution of the first embodiment.

<Third embodiment>

A third embodiment will be described. In this embodiment, an acquiring method of a scooping magnetic force start position is from the first and second embodiments. Other constitutions and actions are similar to those in the first and second embodiments, and therefore, the similar constitutions are omitted from description and illustration or briefly described by adding the same reference numerals or symbols and are omitted from illustration, and in the following, a difference from the first embodiment will be principally described.

In the above-described first and second embodiments, as the magnetic characteristic of the scooping pole S2 in the scooping magnetic force start position, the magnetic characteristic such that the absolute value of the magnetic flux density Br of the scooping pole S2 becomes 20% (preferably 15%) of the absolute value of the maximum value (largest value) thereof was employed. However, in the case where the scooping magnetic force start position is set in the above-described manner, in the low magnetic force region downstream of the peeling pole S3, it becomes hard to set the magnetic characteristic of the scooping pole S2 in the scooping magnetic force start position with the ratio to the absolute value of the maximum value (largest value) of the magnetic flux density Br of the scooping pole S2 as in the first and second embodiments in the case where the magnetic flux density Br is relatively large (for example, about 10 mT) as the value in the low magnetic force region or in the case where the magnetic flux density, Br is on an opposite-polarity side.

Therefore, in this embodiment, a magnetic force change value is acquired in the following manner, and a position where a value becomes 20% (preferably 15%) of the magnetic force change value is used as the scooping magnetic force start position. Further, on a side upstream of the scooping pole is S2 and downstream of the peeling pole S3, a region in which the absolute value of the magnetic flux density Br in the normal direction at the surface of the supplying roller 51 becomes a predetermined value or less is the low magnetic force region. The predetermined value is 5 mT, for example. That is, in this embodiment, the low magnetic force region is the region in which the absolute value of the magnetic flux density Br in the normal direction at the surface of the supplying roller 51 is 5 mT or less. Next, with respect to the rotational direction of the supplying roller 51, an absolute value of a difference between the absolute value of the maximum value of the magnetic flux density Br of the scooping pole S2 in the normal direction at the surface of the supplying roller 51 and an average of values of the magnetic flux density Br in the above-described low magnetic force region is taken as the magnetic force change value. Further, a position where a value becomes 20% (preferably 15%) of this magnetic force change value is taken as the scooping magnetic force start position.

Specifically, the magnetic force change value between the low magnetic force region and the scooping pole is calculated as in the following formula 1.

[Magnetic force change value]=[maximum value (largest value) of magnetic flux density Br of scooping pole]-[average of values of magnetic flux density Br in low magnetic force region] . . . (formula 1)

Here, as the average of values of the magnetic flux density Br in the low magnetic force region, an average of values at 11 points in total when an angle is shifted from a position where the magnetic flux density Br in the low magnetic force region becomes minimum to a position of 5 [deg] with an increment of 1 [deg] in each of an upstream direction and a downstream direction with respect to the rotational direction of the supplying roller 51. Incidentally, an acquiring manner of the average is not limited thereto, but for example, a is manner such that on the side upstream of the scooping pole S2 and downstream of the peeling pole S3, in the region in which the absolute value of the magnetic flux density Br is the predetermined value or less, absolute values of the magnetic flux density Br in an arbitrary plurality of equidistant positions are averaged may be employed.

In this embodiment, with respect to the magnetic force change value acquired by the above-described formula 1, a value which is 20% (preferably 15%) of the acquired magnetic force change value is calculated, and a corresponding position (angle) of the magnetic force proving the magnetic characteristic on the side upstream of the scooping pole S2 with respect to the rotational direction of the supplying roller 51 is defined as the scooping magnetic force start position. Further, as in the first embodiment, the scooping pole S2 is disposed so that the scooping magnetic force start position is developed downstream of the position $\alpha$1 where the line (phantom line $\alpha$) connecting the most downstream position 91 of the wall member 90 and the rotation center position of the supplying roller 51 crosses the surface of the supplying roller 51. Or, as in the second embodiment, the scooping pole S2 is disposed so that the scooping magnetic force start position is positioned downstream, with respect to the rotational direction of the supplying roller 51, of the position $\gamma$1 where the perpendicular line $\gamma$ drawn from the most downstream position 91 of the wall member 90 toward the surface of the supplying roller 51 crosses the surface of the supplying roller 51.

In the case of this embodiment described above, even when the magnetic force in the low magnetic force region varies, the scooping magnetic force start position of the scooping pole S2 can be appropriately calculated.

<Other embodiments>

In the above-described embodiments, the case where the present invention is applied to the developing device for use in the image forming apparatus of the tandem type was described. However, the present invention is also applicable to the developing device for use in the image forming apparatus of another type. Further, the image forming apparatus is not limited to the image forming apparatus for a full-color image, but may also be an image forming apparatus for a monochromatic image or an image forming apparatus for a mono-color (single color) image. Or, the image forming apparatus can be carried out in various uses, such as printers, various printing machines, copying machines, facsimile machines and multi-function machines by adding necessary devices, equipment and casing structures or the like.

Further, also as regards the structure of the developing device, as described above, the structure is not limited to a structure in which the developing chamber and the stirring chamber are disposed in the horizontal direction, but may also be a structure in which the developing chamber and the stirring chamber are disposed in a direction inclined with respect to the horizontal direction. In summary, a constitution in which the developing chamber as the first chamber and the stirring chamber as the second chamber are disposed adjacent to each other so as to partially overlap with each other as viewed in the horizontal direction may only be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2022-011049 filed on Jan. 27, 2022, and 2023-002490 filed on Jan. 11, 2023, which are hereby incorporated by reference herein in their entirety.

What is claimed is:

1. A developing device comprising:

a first chamber configured to accommodate a developer containing toner and a carrier;

a second chamber forming a circulation passage of the developer between itself and the first chamber;

a partition wall configured to partition the first chamber and the second chamber;

a first feeding screw provided in the first chamber and configured to feed the developer in a first direction;

a second feeding screw provided in the second chamber and configured to feed the developer in a second direction opposite to the first direction;

a developing roller configured to carry and convey the toner to a developing position where an electrostatic image formed on an image bearing member is developed;

a supplying roller provided opposed to the developing roller and configured to carry and convey the developer supplied from the first chamber and to supply only the toner to the developing roller, a rotational direction of the supplying roller being opposite to a rotational direction of the developing roller in a position where the supplying roller and the developing roller oppose each other;

a first magnet provided non-rotationally and fixedly inside the developing roller and including a first magnetic pole;

a second magnet provided non-rotationally and fixedly inside the supplying roller and including:

a second magnetic pole which is provided opposed to the first magnetic pole in a position where the supplying roller opposes the developing roller and which is different in polarity from the first magnetic pole, a third magnetic pole provided downstream of the second magnetic pole with respect to the rotational direction of the supplying roller, and a fourth magnetic pole which is provided upstream of the second magnetic pole and downstream of and adjacent to the third magnetic pole with respect to the rotational direction of the supplying roller and which is the same in polarity as the third magnetic pole; and a guiding portion configured to guide, to the first chamber, the developer peeled off from the supplying roller by a repelling magnetic field formed by the third magnetic pole and the fourth magnetic pole, a lowermost end of the guiding portion being close to an uppermost end of the partition wall, wherein the guiding portion overlaps with the supplying roller with respect to a direction of gravitation, and wherein when:

with respect to the rotational direction of the supplying roller, a position which is downstream of a position where a magnetic flux density of the third magnetic pole in a normal direction to an outer peripheral surface of the supplying roller is maximum and upstream of a position where a magnetic flux density of the fourth magnetic pole in the normal direction to the outer peripheral surface of the supplying roller is maximum and at which the magnetic flux density of the fourth magnetic pole in the normal direction is 20% of a maximum value thereof is a first position, as viewed in a cross section perpendicular to a rotational axis of the supplying roller, a position where a rectilinear line connecting the lowermost end of the guiding portion and a rotation center of the supplying roller crosses the outer peripheral surface of the supplying roller is a second position, and as viewed in the cross section perpendicular to the rotational axis of the supplying roller, a position where a rectilinear line connecting an uppermost end of the first feeding screw and the rotation center of the supplying roller crosses the outer peripheral surface of the supplying roller is a third position, with respect to the rotational direction of the supplying roller, the first position is positioned downstream of the second position and upstream of the third position.

2. A developing device according to claim 1, wherein when with respect to the rotational direction of the supplying roller, a position which is downstream of the position where a magnetic flux density of the third magnetic pole in the normal direction is maximum and upstream of the position where the magnetic flux density of the fourth magnetic pole in the normal direction is maximum and at which the magnetic flux density of the fourth magnetic pole in the normal direction is 15% of the maximum value thereof is a fourth position, with respect to the rotational direction of the supplying roller, the fourth position is positioned downstream of the second position and upstream of the first position.

3. A developing device according to claim 1, wherein the guiding portion includes a flat surface portion opposing the supplying roller, the flat surface portion extending to the lowermost end of the guiding portion, and wherein when, as viewed in the cross section perpendicular to the rotational axis, a position where a perpendicular line drawn from the lowermost end of the guiding portion toward the outer peripheral surface of the supplying roller crosses the outer peripheral surface of the supplying roller is a fifth position, with respect to the rotational direction of the supplying roller, the first position is positioned downstream of the fifth position and upstream of the third position.

4. A developing device according to claim 1, wherein as viewed in the cross section perpendicular to the rotational axis of the supplying roller, the lowermost end of the guiding portion is positioned above a rotation center of the second feeding screw.

5. A developing device according to claim 1, wherein the partition wall overlaps with the supplying roller with respect to the direction of gravitation.

6. A developing device comprising:

a first chamber configured to accommodate a developer containing toner and a carrier;

a second chamber forming a circulation passage of the developer between itself and the first chamber;

a partition wall configured to partition the first chamber and the second chamber;

a first feeding screw provided in the first chamber and configured to feed the developer in a first direction;

a second feeding screw provided in the second chamber and configured to feed the developer in a second direction opposite to the first direction;

a developing roller configured to carry and convey the toner to a developing position where an electrostatic image formed on an image bearing member is developed;

a supplying roller provided opposed to the developing roller and configured to carry and convey the developer supplied from the first chamber and to supply only the toner to the developing roller, a rotational direction of the supplying roller being opposite to a rotational direction of the developing roller in a position where the supplying roller and the developing roller oppose each other;

a first magnet provided non-rotationally and fixedly inside the developing roller and including a first magnetic pole;

a second magnet provided non-rotationally and fixedly inside the supplying roller and including:

a second magnetic pole which is provided opposed to the first magnetic pole in a position where the supplying roller opposes the developing roller and which is different in polarity from the first magnetic pole, a third magnetic pole provided downstream of the second magnetic pole with respect to the rotational direction of the supplying roller, and a fourth magnetic pole which is provided upstream of the second magnetic pole and downstream of and adjacent to the third magnetic pole with respect to the rotational direction of the supplying roller and which is the same in polarity as the third magnetic pole; and a guiding portion configured to guide, to the first chamber, the developer peeled off from the supplying roller by a repelling magnetic field formed by the third magnetic pole and the fourth magnetic pole, a lowermost end of the guiding portion being close to an uppermost end of the partition wall, wherein the guiding portion overlaps with the supplying roller with respect to a direction of gravitation, and wherein when:

with respect to the rotational direction of the supplying roller, a position which is downstream of a position where a magnetic flux density of the third magnetic pole in a normal direction to an outer peripheral surface of the supplying roller is maximum and upstream of a position where a magnetic flux density of the fourth magnetic pole in the normal direction to the outer peripheral surface of the supplying roller is maximum and at which the magnetic flux density of the fourth magnetic pole in the normal direction is 20% of an absolute value of a difference between a maximum value of the magnetic flux density of the fourth magnetic pole in the normal direction and an average of magnetic flux densities in a region where absolute values of the magnetic flux densities in the normal direction are 5 mT or less, is a first position, as viewed in a cross section perpendicular to a rotational axis of the supplying roller, a position where a rectilinear line connecting the lowermost end of the guiding portion and a rotation center of the supplying roller crosses the outer peripheral surface of the supplying roller is a second position, and as viewed in the cross section perpendicular to the rotational axis of the supplying roller, a position where a rectilinear line connecting an uppermost end of the first feeding screw and the rotation center of the supplying roller crosses the outer peripheral surface of the supplying roller is a third position, with respect to the rotational direction of the supplying roller, the first position is positioned downstream of the second position and upstream of the third position.

7. A developing device according to claim 6, wherein when with respect to the rotational direction of the supplying roller, a position which is downstream of the position where the magnetic flux density of the third magnetic pole in the normal direction is maximum and upstream of the position where the magnetic flux density of the fourth magnetic pole in the normal direction is maximum and at which the magnetic flux density of the fourth magnetic pole in the normal direction is 15% of the absolute value of the difference is a fourth position, with respect to the rotational direction of the supplying roller, the fourth position is positioned downstream of the second position and upstream of the first position.

8. A developing device according to claim 6, wherein the guiding portion includes a flat surface portion opposing the supplying roller, the flat surface portion extending to the lowermost end of the guiding portion, and wherein when, as viewed in the cross section perpendicular to the rotational axis, a position where a perpendicular line drawn from the lowermost end of the guiding portion toward the outer peripheral surface of the supplying roller crosses the outer peripheral surface of the supplying roller is a fifth position, with respect to the rotational direction of the supplying roller, the first position is positioned downstream of the fifth position and upstream of the third position.

9. A developing device according to claim 6, wherein as viewed in the cross section perpendicular to the rotational axis of the supplying roller, the lowermost end of the guiding portion is positioned above a rotation center of the second feeding screw.

10. A developing device according to claim 6, wherein the partition wall overlaps with the supplying roller with respect to the direction of gravitation.

* * * * *